US008181346B2

(12) United States Patent
Barnat et al.

(10) Patent No.: US 8,181,346 B2
(45) Date of Patent: May 22, 2012

(54) SYSTEM FOR FORMING A LABYRINTH SEAL ON A TURBINE BLADE

(75) Inventors: Krzysztof Barnat, Berlin, CT (US); Bernard D. Vaillette, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 1451 days.

(21) Appl. No.: 11/704,646

(22) Filed: Feb. 9, 2007

(65) Prior Publication Data

US 2008/0189945 A1 Aug. 14, 2008

(51) Int. Cl.
*B21D 53/78* (2006.01)
*B21K 3/04* (2006.01)
*B23P 15/02* (2006.01)

(52) U.S. Cl. ..... 29/889.7; 29/889; 29/889.1; 29/889.2; 29/402.18; 51/295; 51/307; 51/308; 451/364; 451/365

(58) Field of Classification Search ..... 29/889, 29/889.2, 889.7, 889.1, 402.18; 51/295, 51/308, 307; 236/533.12; 451/4, 72, 226, 451/365

See application file for complete search history.

(56) References Cited

U.S. PATENT DOCUMENTS 3,986,847 A * 10/1976 Balson ..... 51/308
4,128,929 A * 12/1978 DeMusis ..... 29/889.1
4,607,460 A * 8/1986 Mushardt ..... 451/4
4,827,675 A 5/1989 Andrews
7,150,101 B2 * 12/2006 Smith et al. ..... 29/890.142

FOREIGN PATENT DOCUMENTS

EP 1215012 A 6/2002
JP 6312358 A 11/1994

* cited by examiner

*Primary Examiner* — Richard Chang
(74) *Attorney, Agent, or Firm* — Bachman & LaPointe, P.C.

(57) ABSTRACT

A system for forming a labyrinth seal on a turbine blade has a fixture with a plurality of nozzles for distributing a coolant, a first jaw set for clamping and holding a root portion of the turbine blade in a first orientation, which first jaw set is attached to the fixture and has two members for mating with said root portion of said turbine blade, each of the jaw set members respectively have ridges; and a plurality of grinding wheels for forming the labyrinth seal.

10 Claims, 13 Drawing Sheets

SYSTEM FOR FORMING A LABYRINTH SEAL ON A TURBINE BLADE

BACKGROUND OF THE INVENTION (1) Field of the Invention

The present invention relates to a process for machining blade labyrinth seals used on blades. The present invention has particular utility in the manufacture of turbine blades for gas turbine engines.

(2) Background

A seal design has been developed which integrates the seal into the turbine disk and mating turbine blades. This design, sometimes called a labyrinth seal, incorporates a seal located radially at the blade. The challenge is to machine the thin labyrinth form on the turbine blades, without generating any part deflection and meeting all profile and metallurgical requirements.

There is no prior technology which has machined labyrinth features on blades used in gas turbine engines. Wire EDM (electric discharge machining) has been used to machine some blades; however, such a technique generates unacceptable metallurgy. Grinding technology does exist which machines blade root forms, but this technology has not been used to machine such a thin feature which is very susceptible to movement.

SUMMARY OF THE INVENTION

A process for machining a labyrinth seal for a turbine blade is provided. The process broadly comprises the steps of providing a turbine blade blank having a portion to be cut to form the labyrinth seal, positioning the blank in a first set of jaws, performing a plurality of cuts to form the labyrinth seal, removing the machined blank with the labyrinth seal from the first set of jaws, placing the machined blank into a second set of jaws, and performing a final cut to grind a bottom surface of the labyrinth seal.

A system for forming a labyrinth seal on a turbine blade is provided. The system broadly comprises a fixture having a plurality of nozzles for distributing coolant into a grinding area, a first jaw set for holding the turbine blade in a first orientation attached to the fixture, and a plurality of grinding wheels for forming the labyrinth seal.

Other details of the blade labyrinth feature machining of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

The process of the present invention utilizes the positive properties of a unique grinding, clamping and coolant technique to generate acceptable labyrinth seal features in a blade used in a gas turbine engine.

Figure 1:
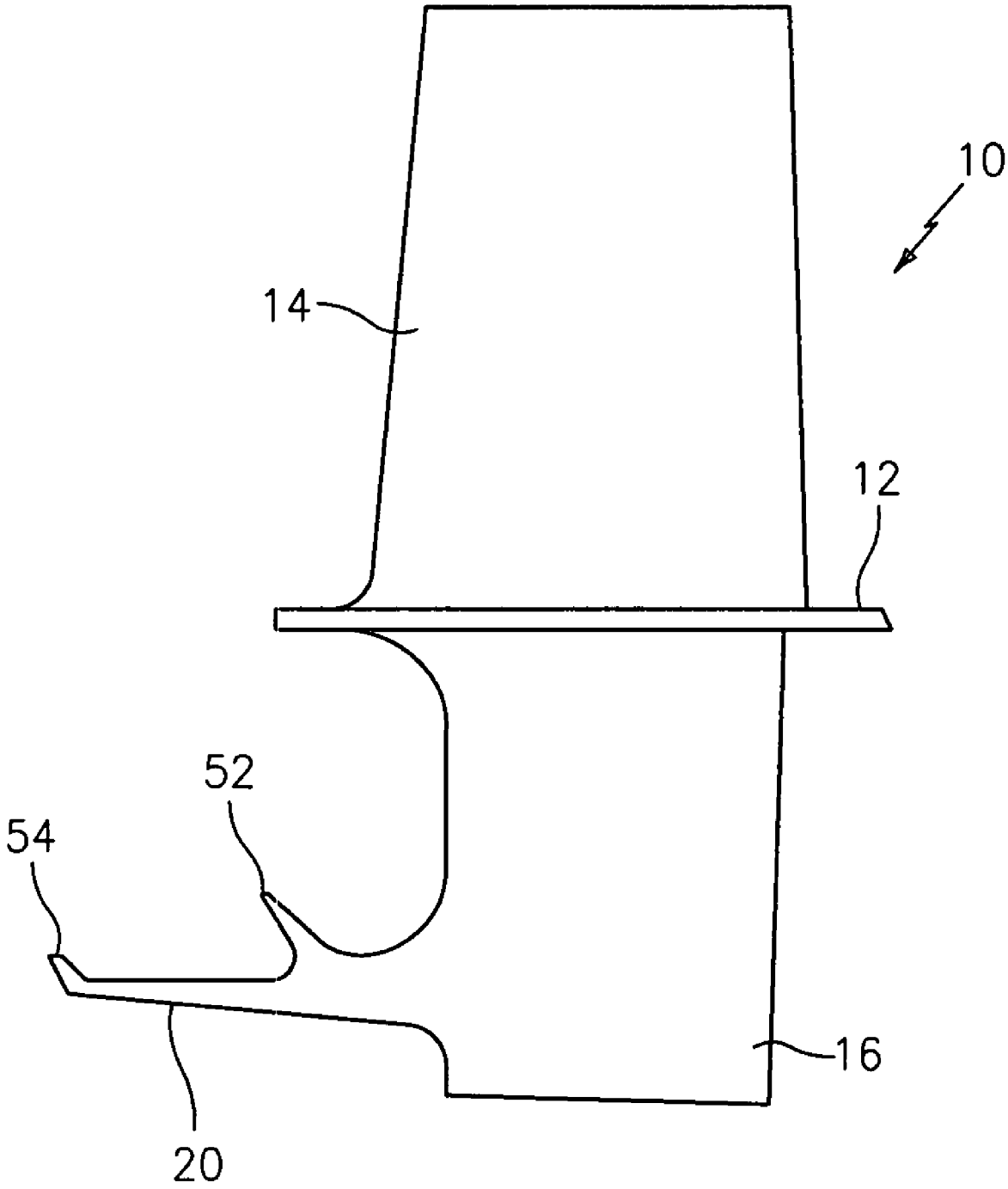
FIG. 1 is a side view of a turbine blade having a labyrinth seal.

Referring now to the drawings, FIG. 1 illustrates a turbine blade 10 having a platform 12, an airfoil portion 14, and a root portion 16. The turbine blade 10 also has a labyrinth seal 20 which includes a first knife edge member 52 and a second knife edge member 54. The knife edge members 52 and 54 may be machined using the process of the present invention.

As will be described in more detail hereinafter, the process for machining the knife edge members 52 and 54 utilizes three different grinding wheels, which grinding wheels may be vitrified bond grinding wheels.

Figure 2:
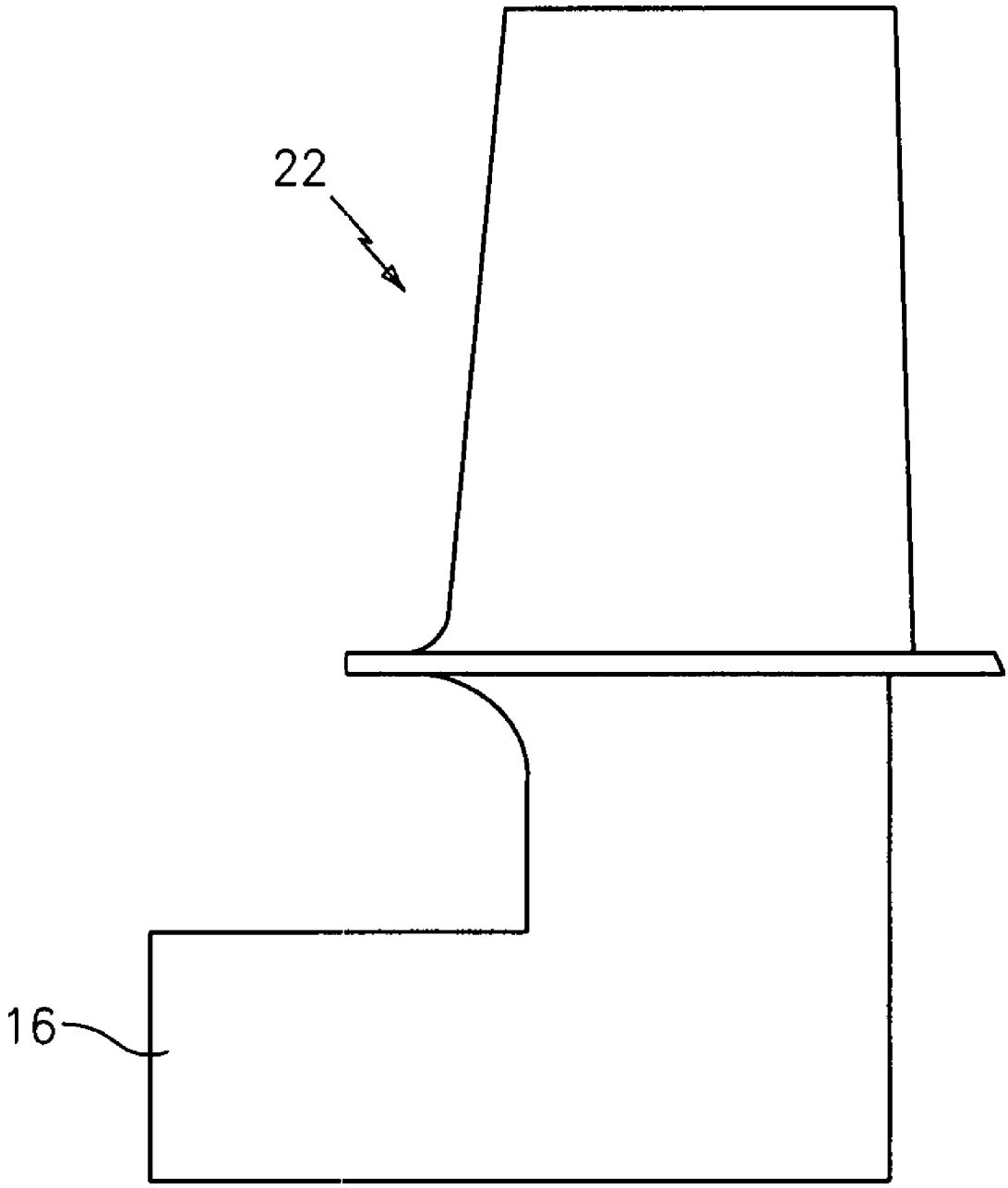
FIG. 2 is a side view of a cast turbine blade prior to machining the labyrinth seal.
Figure 3A:
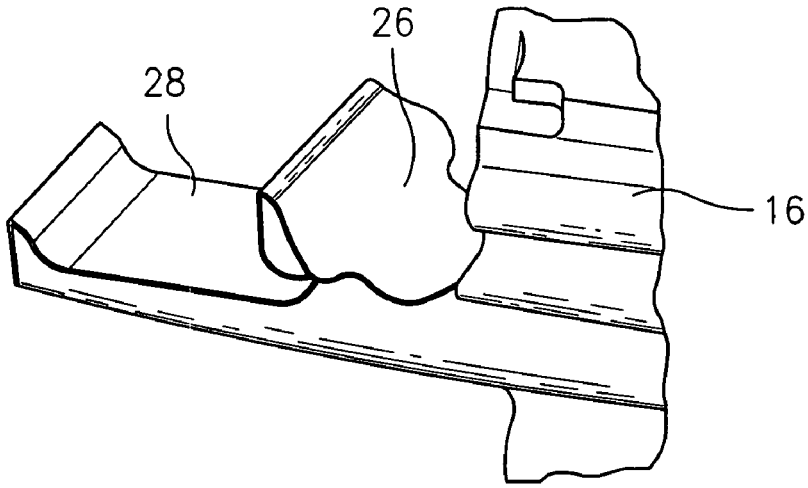
FIG. 3A illustrates the tip area of the root portion of the turbine blade to be machined.
Figure 3B:
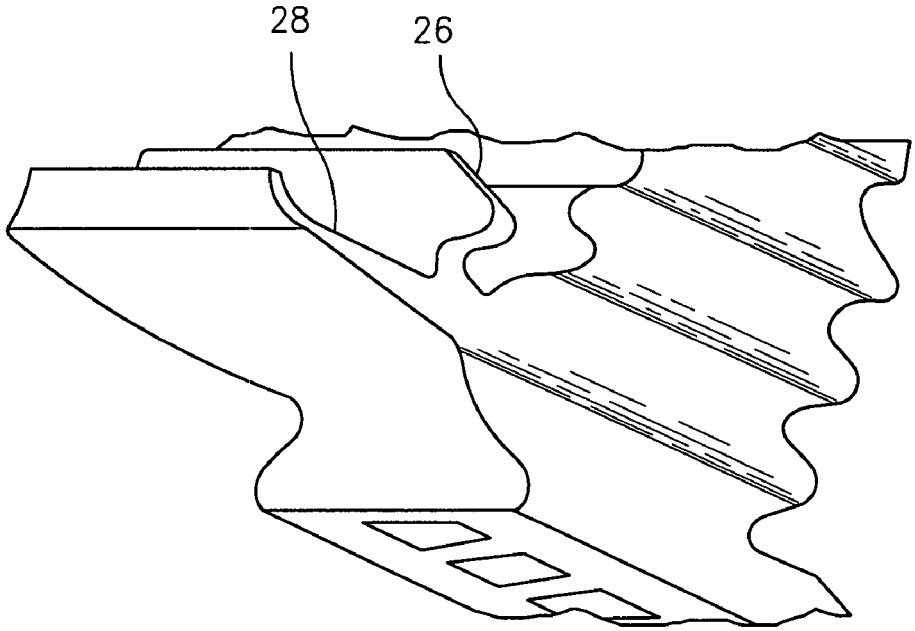
FIG. 3B illustrates the bottom area of the root portion of the turbine blade to be machined.

Referring now to FIG. 2, there is shown the raw form or blank 22 of the turbine blade 10 to be machined. The turbine blade 10 is typically a cast structure formed from a nickel-based or cobalt-based alloy. The areas to be machined are located in the root portion 16 of the blade 10. FIG. 3A shows the tip areas 26 and 28 of the root portion 16 which are machined during the process of the present invention, while FIG. 3B shows the bottom area to be machined.

Figure 4A:
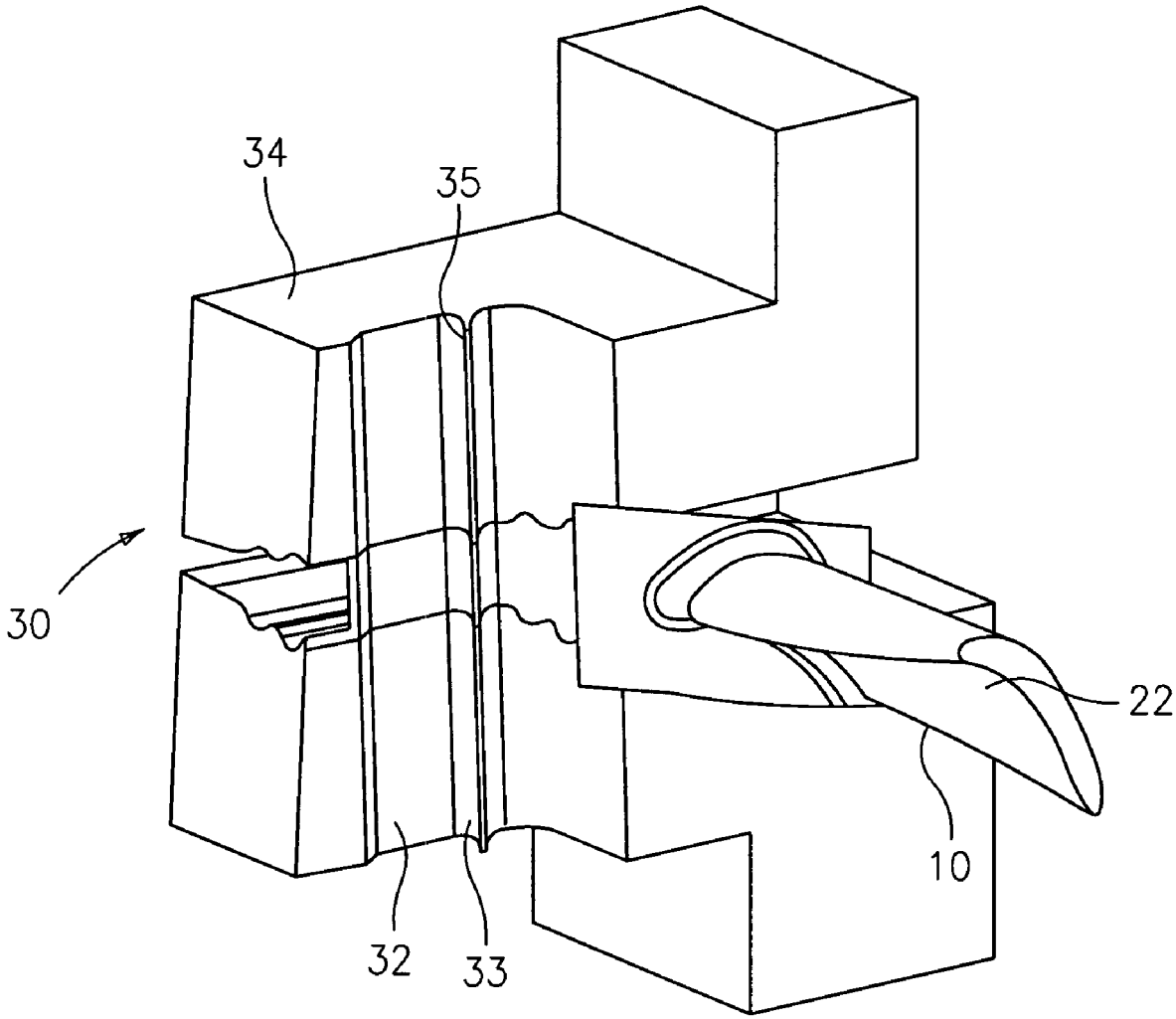
FIGS. 4A-4C illustrate a first jaw set used to clamp and hold the turbine blade to be machined for the first four cuts.
Figure 4C:
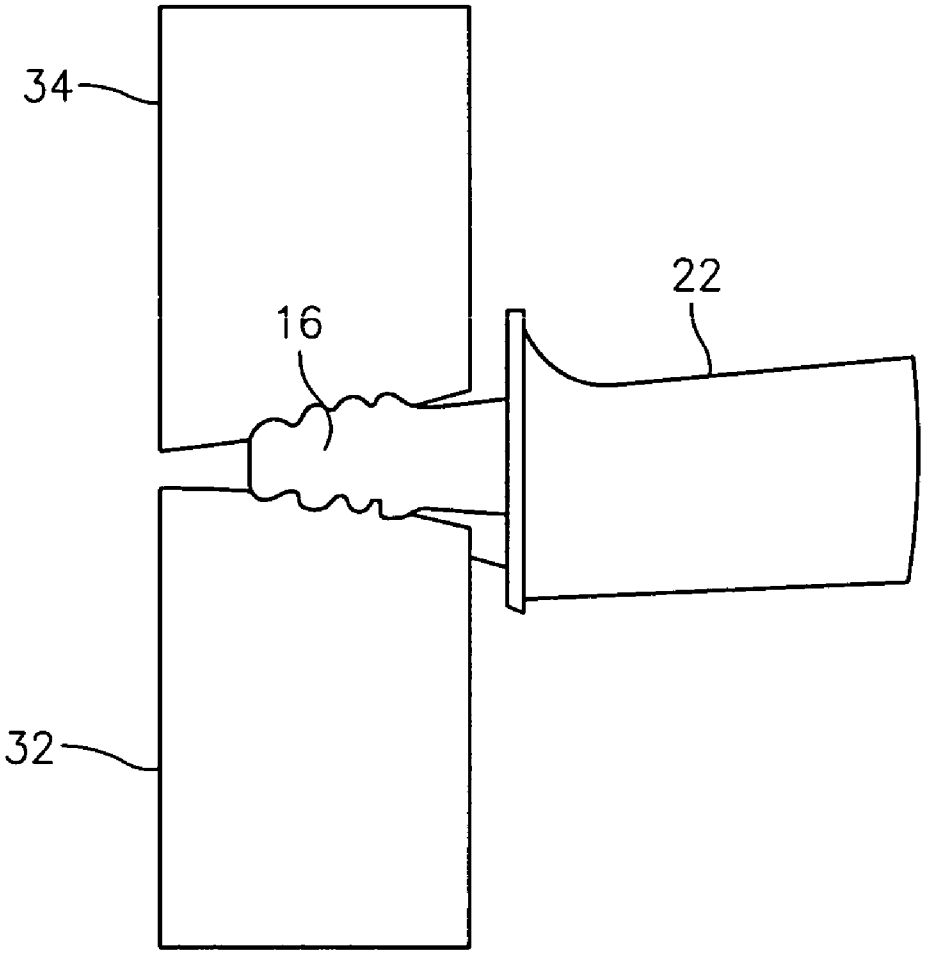
Figure 4B:
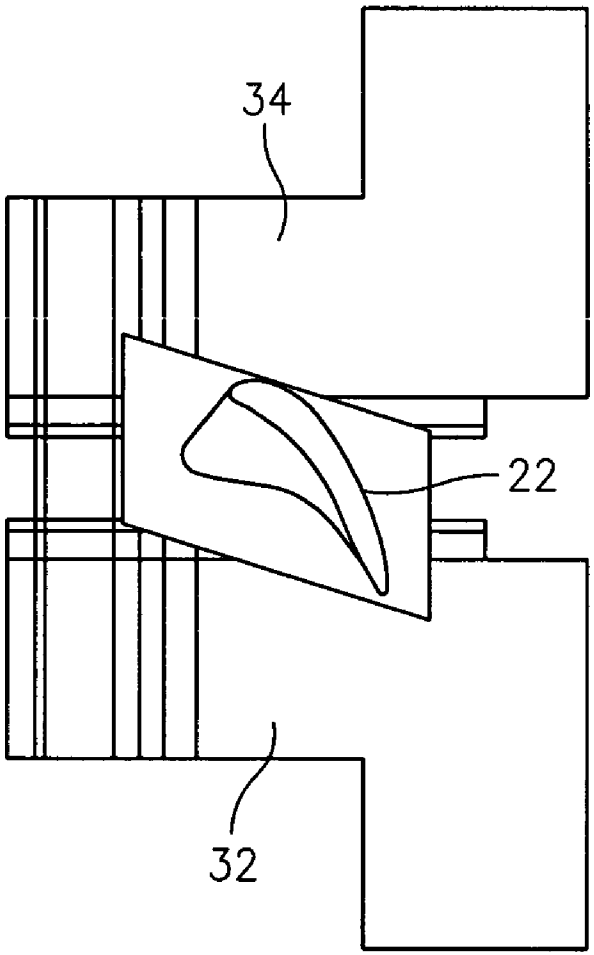

Referring now to FIGS. 4A-4C, there is shown a first jaw set 30 for clamping the root portion 16 of the blade 10 and holding the blade 10 in position during the first four cutting operations. As can be seen from this figure, the first jaw set 30 includes a first jaw member 32 and a second jaw member 34. Jaw member 32 stays fixed while jaw member 34 is able to move. The blade 10 gets placed on jaw member 32. Then jaw member 34 clamps down on the blade 10. The jaw members 32 and 34 mate with the root portion 16 of the blade 10. The jaw members 32 and 34 have ridges 33 and 35 respectively, which ridges are aligned with each other and with the first knife edge 52 to be formed as part of the labyrinth seal 20. When positioned in the jaw set 30, the areas 26 and 28 to be cut are exposed to a grinding wheel 46.

Figure 5B:
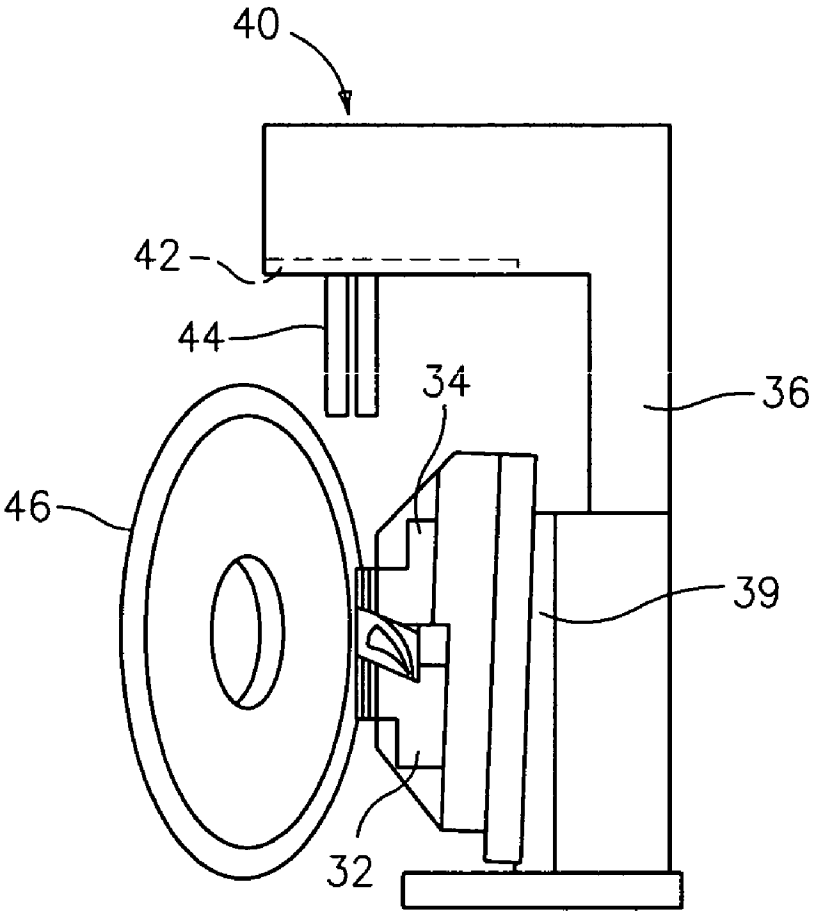
FIG. 5A-5B illustrate a fixture used during the machining process of the present invention.
Figure 5A:
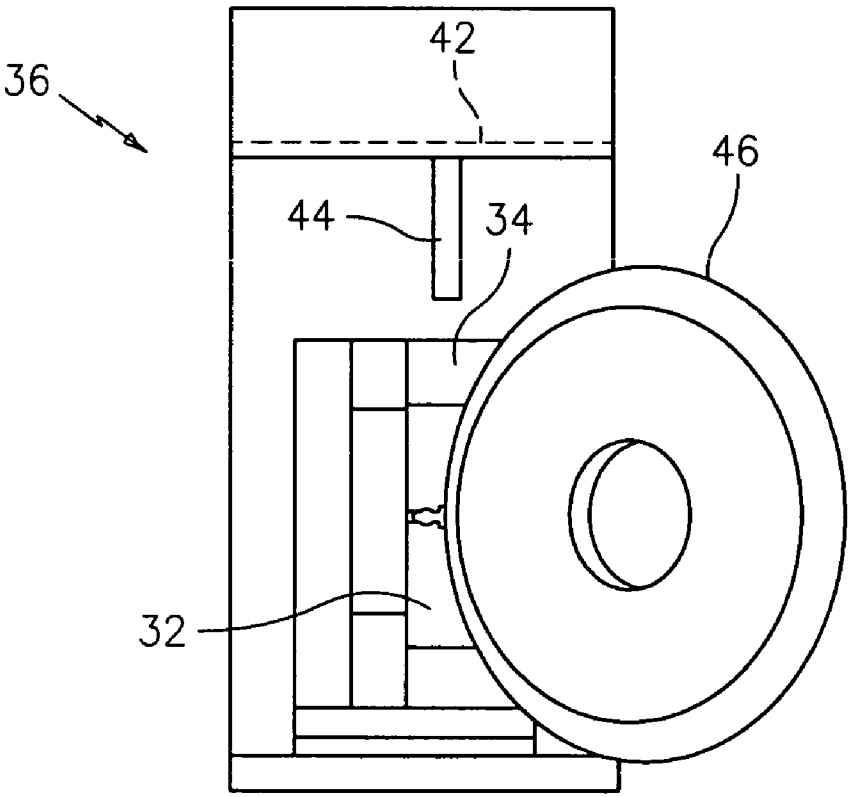

Referring now to FIGS. 5A and 5B, the jaw set members 32 and 34 are removably attached to a fixture 36. Any suitable means known in the art, such as removable bolts or screws, may be used to hold the jaw set members 32 and 34 to the fixture. Referring now to FIG. 5B, a hard stop 39 at one end of the fixture 36 positions the blade 10 within the jaw members 32 and 34.

The fixture 36 has a coolant nozzle base 40 which is attached to a source (not shown) of a coolant fluid. A coolant plate 42 may be attached to the base 40 using any suitable means known in the art. The coolant plate 42 has a plurality of coolant nozzles 44. The coolant nozzles 44 are oriented to aim the coolant directly at the grinding zone between the grinding wheel 46 and the blank 22. Since different cuts are being made in different areas, when a coolant plate is used, the coolant plate 42 may be replaced after particular cuts by another coolant plate 42 having coolant nozzles 44 aimed at the next site for cutting. The coolant may be a water soluble coolant or any other suitable coolant known in the art. If desired, the coolant plate 42 may be omitted and the nozzles 44 may be movable so that coolant is directed to the grinding zone.

Each cut is performed by a grinding wheel 46 attached to a suitable grinding machine (not shown), such as a 4-axis Edgetek grinding machine. Each grinding wheel 46 may be a vitrified bond cubic boron nitride grinding wheel or any other suitable grinding wheel. The fixture 36 may include a dresser roll (not shown) for instances when a grinding wheel which requires dressing is used. The dresser roll is not needed if a wheel which doesn't require dressing is used, for example, a CBN plated wheel.

Figure 6:
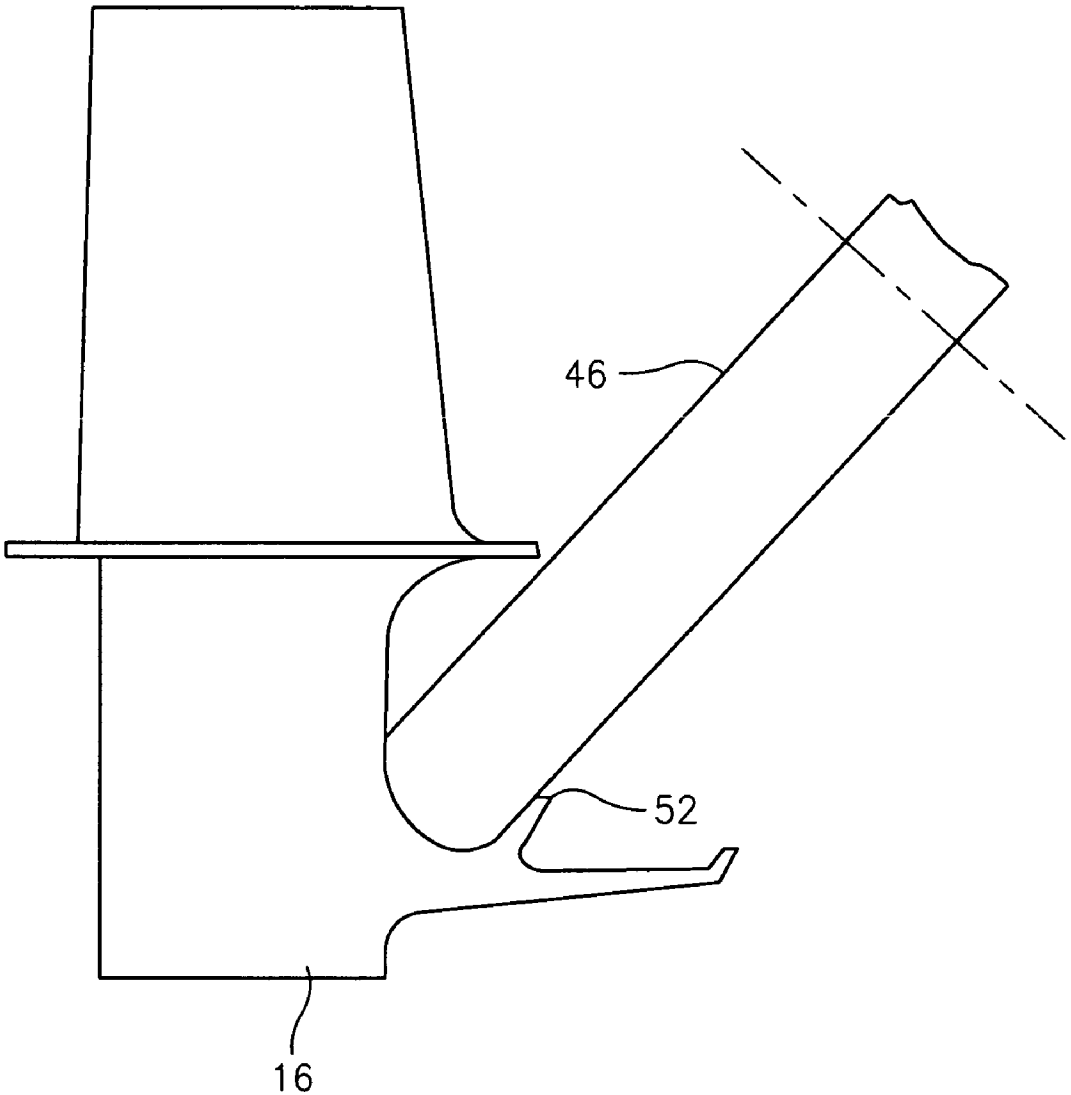
FIG. 6 illustrates the first cut made as part of the process of the present invention.

The process for making the first four cuts is as follows. The first step is to set up the coolant nozzles 44 and the grinding wheel 46 for the first cut. The coolant nozzles 44 are directed at the grind zone between the grinding wheel 46 and the blade. After the set up has been completed, the grinding wheel 46 may be dressed if necessary. In the case of a vitrified wheel, the grinding wheel may be plunged into a form dresser which generates the correct geometry. Then the first cut is made as shown in FIG. 6. The grinding wheel 46 grinds the region between the root 16 and the knife edge 52 taking a number of passes at different depths of cut.

Figure 7:
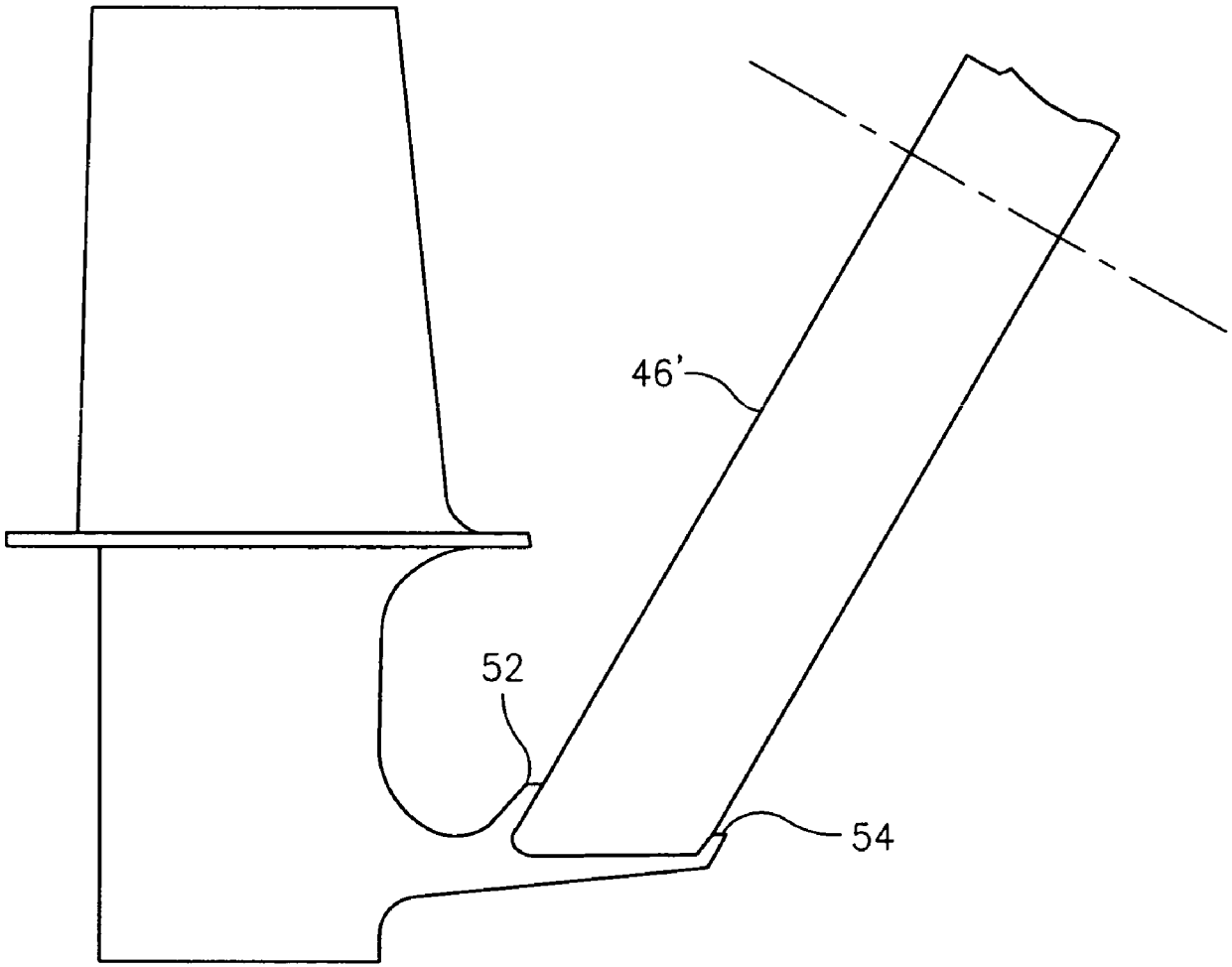
FIG. 7 illustrates the second cut made as part of the process of the present invention.

After the first cut has been completed, the coolant nozzles 44 orientation plate 42 and the grinding wheel 46 are changed and the second coolant nozzle 44 configuration and the second grinding wheel 46' are set up. After the set up has been completed, the second grinding wheel 46' may be dressed if necessary. Then the second cut is made as shown in FIG. 7. In this step, the region between the two knife edges 52 and 54 is ground taking a number of passes at different depths of cut.

Figure 8:
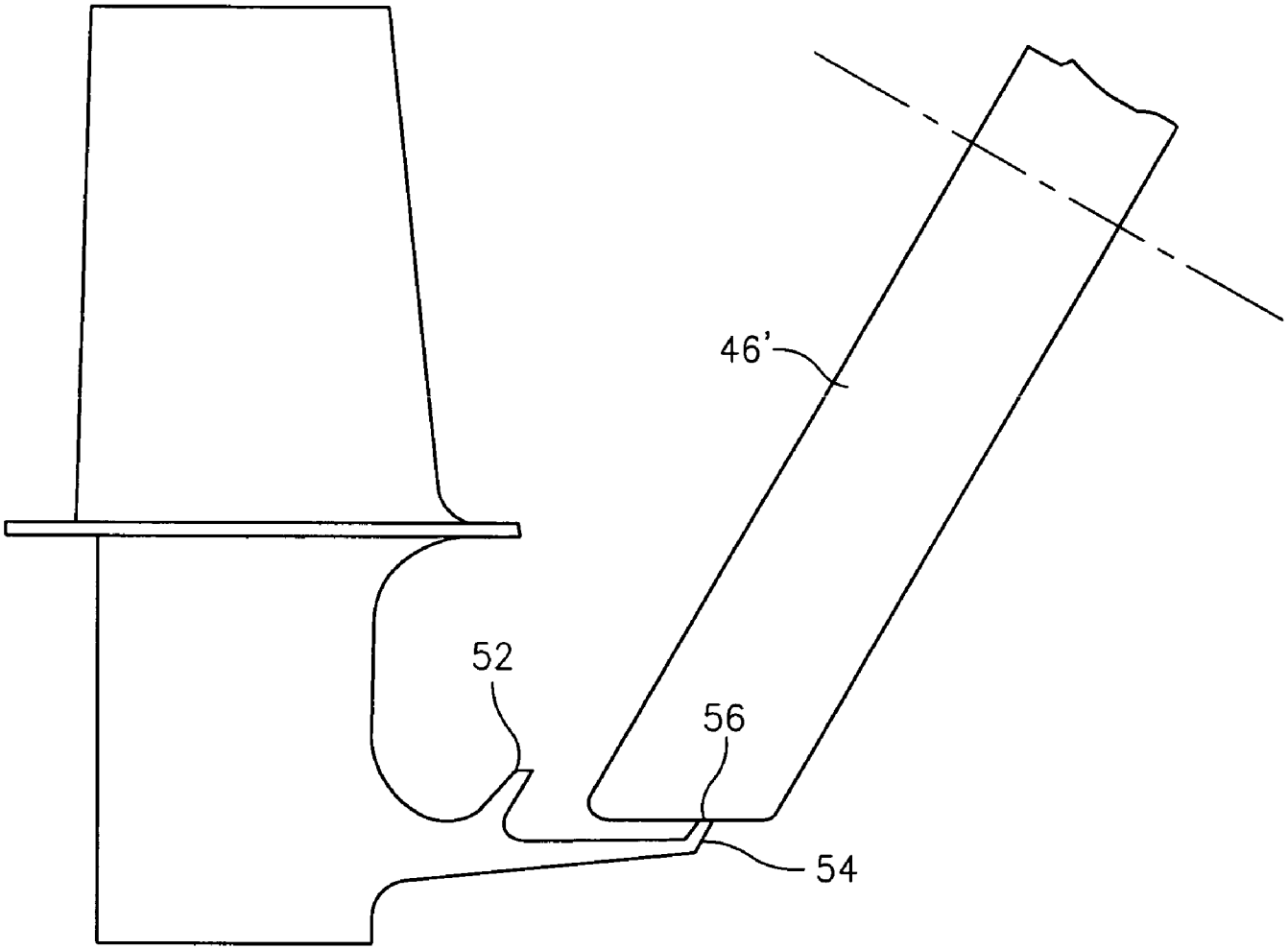
FIG. 8 illustrates the third cut made as part of the process of the present invention.
Figure 9:
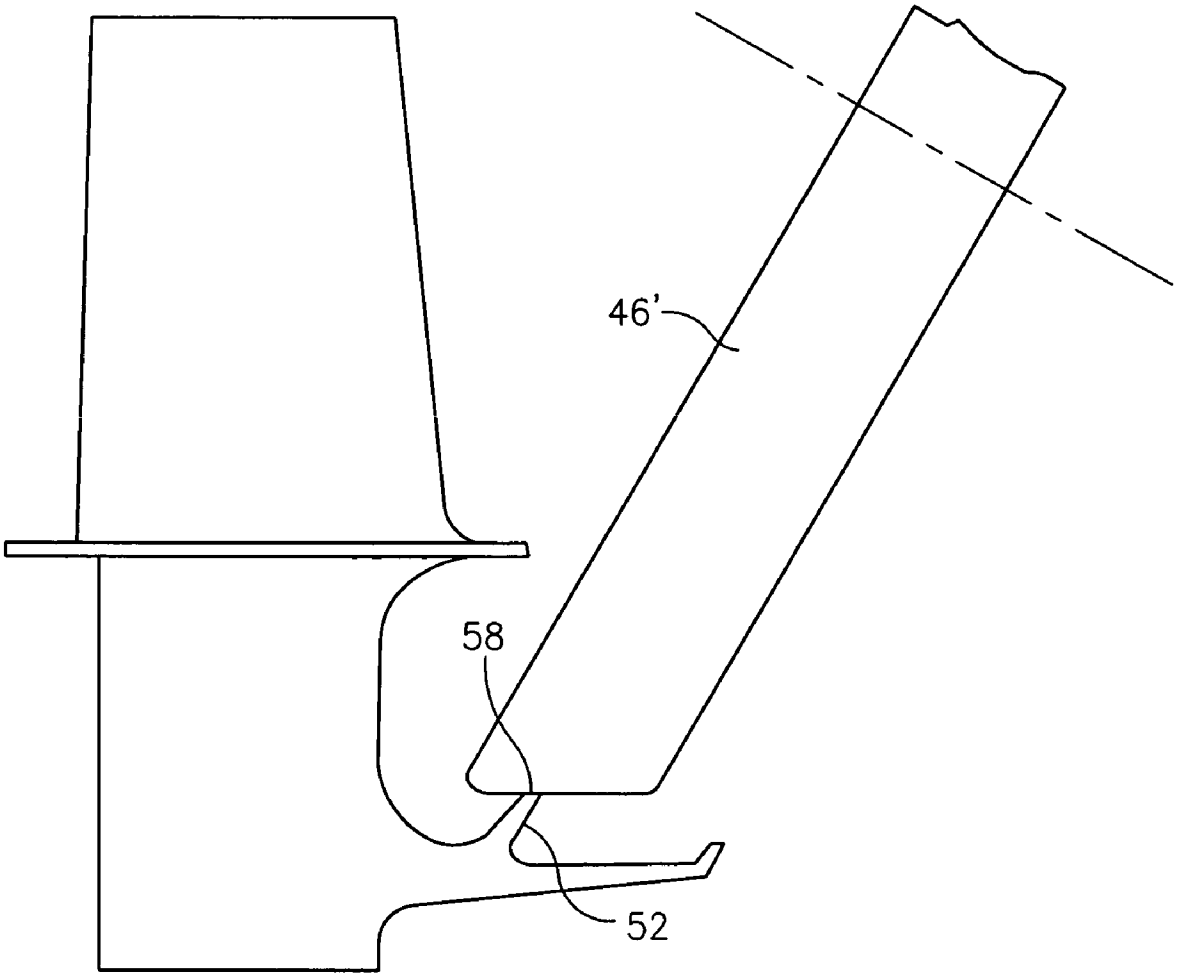
FIG. 9 illustrates the fourth cut made as part of the process of the present invention.

After the second cut has been completed, the second coolant nozzle 44 orientation is changed and a third coolant nozzle 44 configuration is used. The third cut is made as shown in FIG. 8. The third cut grinds the top 56 of the outer knife edge 54 taking a number of passes at different depths of cut. After the third cut is finished, the fourth cut is performed as shown in FIG. 9. The fourth cut grinds the top 58 of the inner knife edge 52 taking a number of passes at different depths of cut.

Figure 11A:
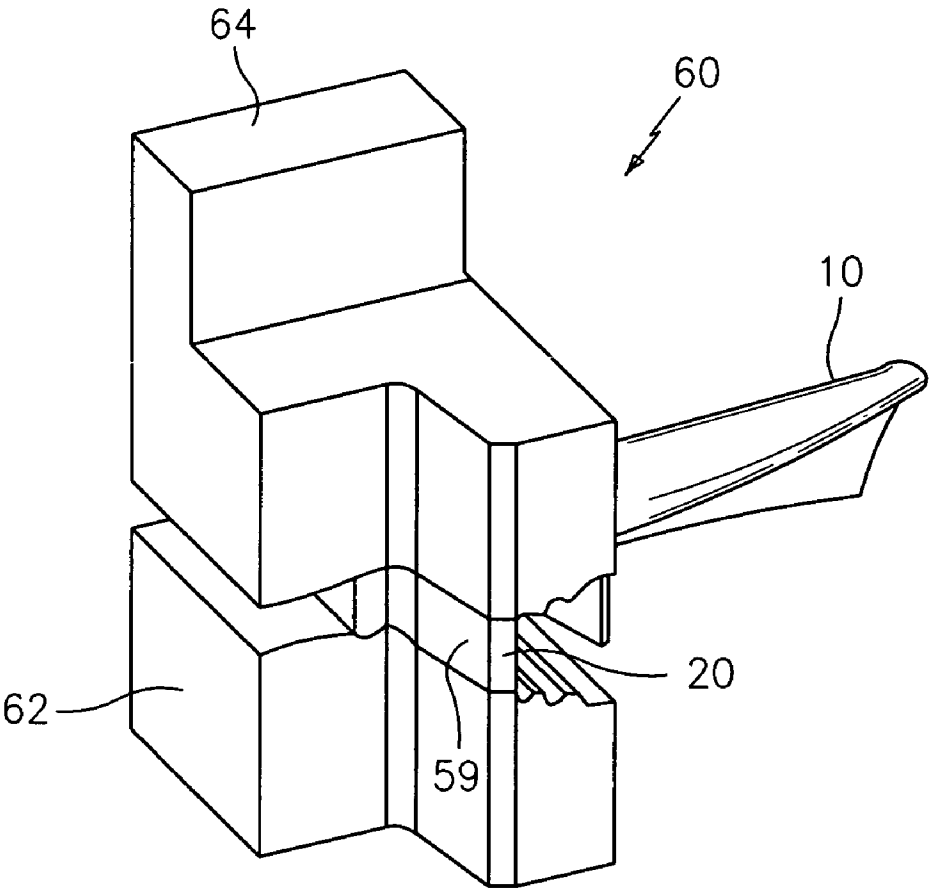
FIG. 11A-11C illustrate a second set of jaws used to hold the blade during the fifth cut.
Figure 11C:
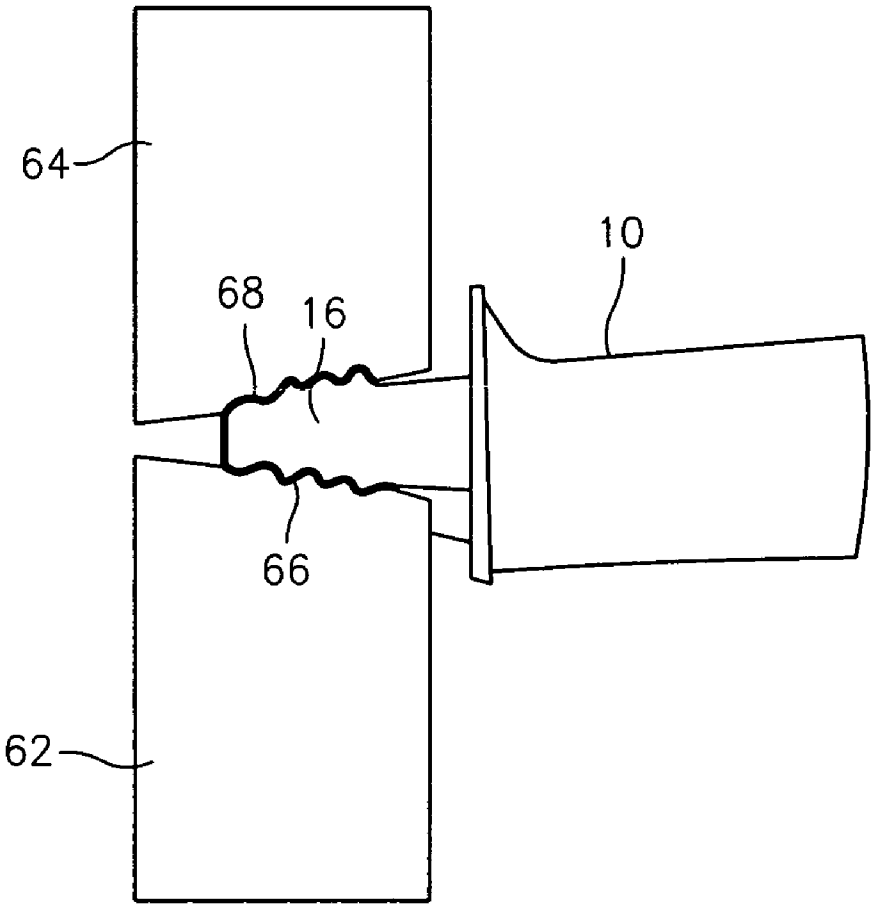
Figure 11B:
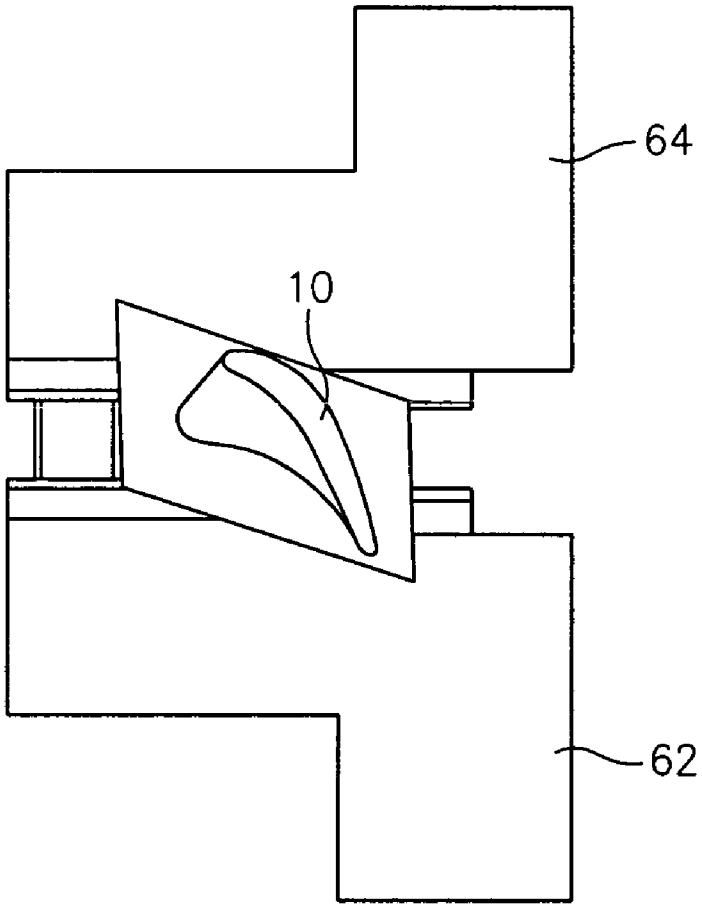

After the first: four cuts have been completed, the blade 10 is removed from the first jaw set 30 and the first jaw set 30 is replaced by the second jaw set 60 shown in FIGS. 11A-11C. As can be seen by comparing FIGS. 4A and 11A, the second jaw set 60 holds the blade 10 at an orientation which is 90 degrees offset from the orientation at which the first jaw set 30 holds the blade 10. This is so the grinding wheel 46 can have access to the bottom of the labyrinth seal.

The second jaw set 60 has a first jaw member 62 and a second jaw member 64. The jaw members 62 and 64 grip the labyrinth seal 20 while exposing the bottom surface 59. As can be seen from FIG. 11C, the jaw members 62 and 64 have portions 66 and 68 which grip the root portion 16 of the blade.

Figure 10:
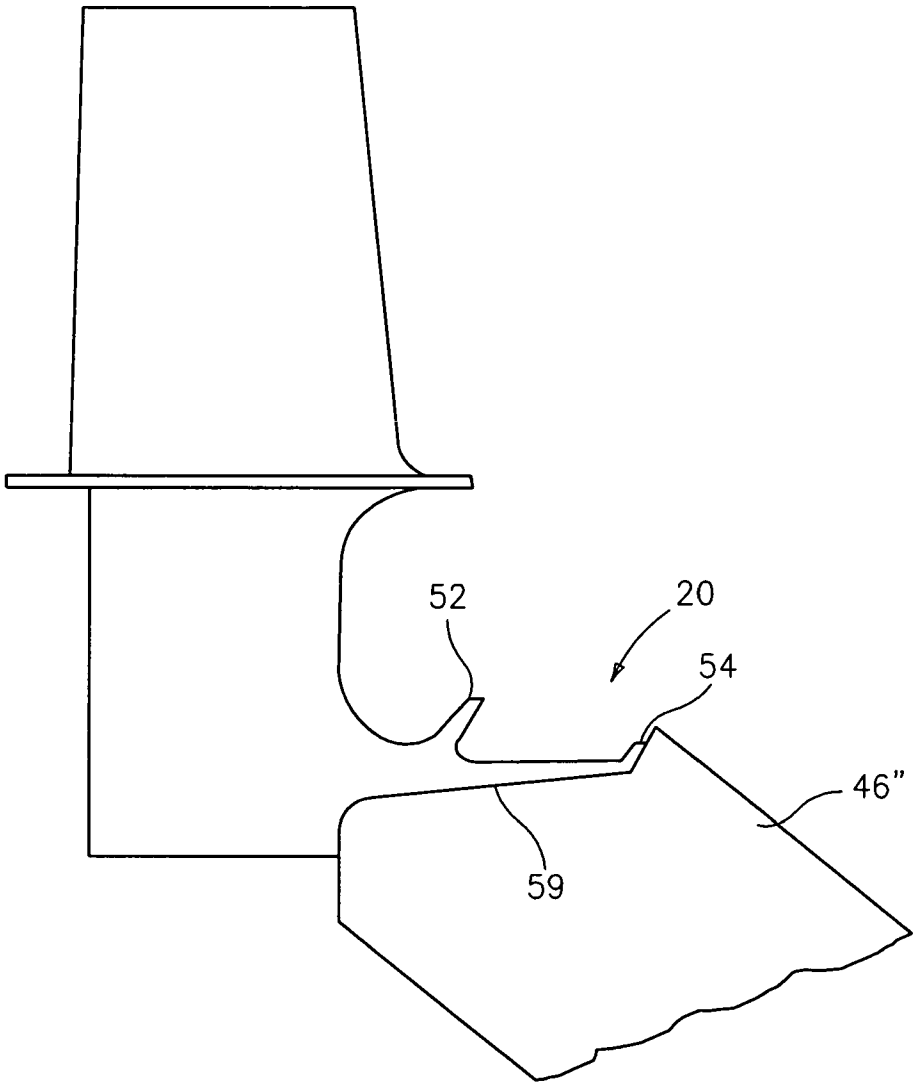
FIG. 10 illustrates a fifth cut.

After the second jaw set 60 has been installed in the fixture 36, the third coolant nozzle 44 orientation is replaced by a fourth coolant nozzle 44 orientation. Additionally, the grinding wheel 46' is replaced by the third grinding wheel 46". The last and final cut as shown in FIG. 10 grinds the bottom surface 59 of the labyrinth seal 20.

As can be seen from the foregoing description, a process and a system have been provided for machining blades that include labyrinth seals. The process may use vitrified bond grinding wheels to machine this feature of a blade. The process generates low cutting forces. In order to prevent part movement, two sets of jaws are used during the process to clamp on the thin labyrinth seal. To maintain low cutting forces and proper metallurgical results, coolant is aimed precisely within the grinding zone during each grinding step. The jaws in each set act as flow guides to help precisely focus the coolant into the grind zone. Any coolant that is off target will hit the jaws, which will guide the coolant back to the grind zone.

It is apparent that there has been provided in accordance with the present invention a blade feature machining which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations which fall within the broad scope of the appended claims.

What is claimed is:

1. A system for forming a labyrinth seal on a turbine blade, said system comprising:

a fixture having a plurality of nozzles for distributing a coolant;

a first jaw set for clamping and holding a root portion of said turbine blade in a first orientation, said first jaw set being attached to said fixture;

said first jaw set having two members for mating with said root portion of said turbine blade;

each of said members respectively having ridges; and a plurality of grinding wheels for forming said labyrinth seal.

2. The system of claim 1, wherein each of said grinding wheels comprises a vitrified bond cubic boron nitride wheel.

3. The system of claim 1, wherein said plurality of grinding wheels comprises a first means for grinding a region between a root portion of the turbine blade and a first knife edge.

4. The system of claim 3, wherein said plurality of grinding wheels comprises a second means for grinding a region between the first knife edge and a second knife edge, for grinding a top portion of the second knife edge, and for grinding a top portion of the first knife edge.

5. The system of claim 1, comprising a second jaw set for holding said turbine blade with said machined labyrinth seal at a second orientation perpendicular to said first orientation.

6. The system of claim 5, wherein said plurality of grinding wheels comprises a third means for grinding a bottom surface of said labyrinth seal.

7. The system of claim 1, wherein said plurality of grinding wheels comprises three grinding wheels with the first two of said grinding wheels being used to form the labyrinth seal and the third of said grinding wheels being used to grind a bottom surface of said labyrinth seal.

8. The system of claim 1, wherein a first one of said two jaw members is fixed and a second one of said two jaw members is movable.

9. The system of claim 1, wherein said ridges are aligned with each other and with first knife edge to be formed.

10. The system of claim 1, wherein said first jaw set is removably attached to said fixture and said fixture has a hard stop to position the blade within the jaw members.

* * * * *